US006518933B2

(12) United States Patent
Pecora, Jr. et al.

(10) Patent No.: US 6,518,933 B2
(45) Date of Patent: Feb. 11, 2003

(54) LOW PROFILE ANTENNA

(75) Inventors: Ronald A. Pecora, Jr., East Falmouth, MA (US); Eugene C. Cullie, Franklin, MA (US)

(73) Assignee: ADS Corporation, Huntsville, AL (US)

( * ) Notice: Subject to any disclaimer, the term of this patent is extended or adjusted under 35 U.S.C. 154(b) by 0 days.

(21) Appl. No.: 09/870,232

(22) Filed: May 30, 2001

(65) Prior Publication Data

US 2002/0180656 A1 Dec. 5, 2002

(51) Int. Cl.[7] ..... H01Q 9/16
(52) U.S. Cl. ..... 343/793; 343/795; 343/872
(58) Field of Search ..... 343/793, 795, 343/872, 873, 719, 700 MS

(56) References Cited

U.S. PATENT DOCUMENTS 2,563,243 A * 8/1951 Hills ..... 343/747
2,627,026 A * 1/1953 Kadoian et al. ..... 174/17.05
3,961,332 A * 6/1976 Middlemark ..... 343/792
5,124,714 A 6/1992 Harada
5,168,279 A * 12/1992 Knight ..... 324/95
5,184,143 A 2/1993 Marko
5,298,894 A 3/1994 Cerney et al.
5,583,492 A 12/1996 Nakanishi et al.
5,929,812 A 7/1999 Aminzadeh
6,037,912 A 3/2000 DeMarre
6,310,586 B1 * 10/2001 Takahashi et al. ... 343/700 MS

OTHER PUBLICATIONS

G.A. Venkatesh, The Agony and the Ecstasy of Kitbuilding, Mar. 2000, section 8, published at http://24.3.145.56/velocity/Report8.html, pp. 182 and 1–7.
K3MT, The Grasswire, Apr. 1997, published at http:/users.erol.com/k3mt/graswire.htm, pp. 1–6.
Radiall/Larsen Antenna Technologies, Antenna Source Book 2000 addendum, p. 5.

* cited by examiner

*Primary Examiner*—Tan Ho
(74) *Attorney, Agent, or Firm*—Katten Muchin Zavis Rosenman

(57) ABSTRACT

A dipole antenna is constructed of flexible conductive elements. These elements are encased in a flexible protective covering or attached to a semi-rigid substrate. This covering protects the antenna during handling, transport, and installation. The conductive elements and the protective covering may be further encased or embedded in an external protective covering. The final external protective covering serves as an adhesive to permanently attach the antenna to a mounting surface. When installed on the mounting surface, the antenna has a low profile with respect to the mounting surface.

35 Claims, 2 Drawing Sheets

LOW PROFILE ANTENNA

FIELD OF THE INVENTION

The present invention relates generally to antennas. More particularly, the present invention relates to antennas having a low profile for use in roadways, sewer manholes, and other applications where a low profile is desirable.

BACKGROUND OF THE INVENTION

The collection of data from sanitary or storm sewer networks and other underground or enclosed systems has become increasingly common and useful. For example, in an underground sewer network, flow monitors may be used to collect data such as depth, volume, velocity, and/or other measurable parameters in a certain location. When such monitors are used, it is often desirable to collect the data in a central location, such as a remote computer or data collection system, so that data from multiple monitors can be analyzed, stored, processed, compared, and/or presented to a user. Because of the impracticality of connecting monitors that may be located throughout such a sewer or other network to a central processor via direct wiring, it is desirable that such monitors transmit their data to a remote computer through a wireless communications medium.

The application of wireless technology to transmit and/or receive data from and/or deliver data to flow monitors requires a suitable antenna for reception and/or transmission. For example, sewer flow monitors are typically installed within a sewer network inside or near manholes in order to provide access for installation, maintenance, and repair. Thus, the monitor may communicate with a remote unit via a wireless transmitter that is also located near or within the manhole. However, if transmitter's antenna is mounted so that the antenna is below the manhole's cover, substantial losses in signal strength, such as RF energy losses, will result from factors such as signal attenuation and the fact that the antenna is mounted below the ground plane.

One solution to this problem is to mount the antenna above the ground, outside of the manhole. However, conventional antennas normally require a mast or pole type of mounting. Thus, conventional antennas have an elevation that renders them undesirable for use in many locations, such as roadways and sidewalks where vehicular and/or pedestrian traffic will flow. Thus, a shorter, or low profile, antenna is desirable in such a location.

Existing low profile antennas still require a substantial elevation above the ground surface. Examples of such antennas may be found in U.S. Pat. No. 5,877,703, to Bloss et al. Such antennas are subject to abuse from, and may be damaged by, roadway traffic, such as cars, trucks, buses, and other vehicles, as the traffic drives over them, directly placing substantial loads on the antenna. Other roadway vehicles such as snowplows can cause even more damage to an antenna that is raised above the roadway. In addition, such antennas require modification to the manhole cover, such as the drilling of a hole, to connect the above-ground antenna to the underground flow meter. Such holes are generally large, as they are also used as a means to secure the antenna to the manhole and/or to connect the antenna to equipment below the manhole cover.

Accordingly, it is desirable to provide an improved low profile antenna as disclosed herein.

SUMMARY OF THE INVENTION

It is therefore an object of the present invention to provide an improved low profile antenna.

It is an additional object of the present invention to provide an antenna having a profile that reduces or eliminates the susceptibility for damage of the antenna resulting from roadway traffic.

In accordance with a preferred embodiment of the present invention, a low profile antenna for receiving and/or transmitting radio frequencies includes a first elongated element made from an electrically conductive material, a second elongated element made from the electrically conductive material, and a cable that is conductively attached to the first and second elongated elements. The first and second elongated elements each have a height that is of a low profile and lengths that are substantially equal. The elongated elements are covered at least partially with a substantially non-conductive covering.

Optionally and preferably, the first elongated element and the second elongated element are positioned to extend in opposite directions, form substantially a straight line, and are separated by a gap to provide a dipole antenna. Also optionally, the first elongated element and the second elongated element are sized and positioned to fit within one or more grooves or recesses of a standard manhole cover.

In accordance with the above-described embodiment, the electrically conductive material preferably includes copper. The height that is of a low profile is preferably about one-fourth of an inch or less, and the optional substantially straight line formed by the first and second elements has a length that corresponds to an operating frequency band of the antenna. The length preferably provides an electrically tuned antenna that is capable of transmission in close proximity to a surface.

As additional options, the cable has a diameter that is at least as small as the diameter of a standard manhole cover opening, and the substantially non-conductive covering is comprised of at least one of rubber, plastic, non-metallic tubing, an adhesive, and a non-metallic substrate. The cable may also be connected to a transmitter and/or a receiver. Optionally, the antenna includes an adhesive material that is affixed to at least a portion of the substantially non-conductive covering. Also optionally, the elongated elements may be positioned within at least one groove or recess of a standard manhole cover, or they may be embedded within or flush with a traffic surface.

In accordance with an alternate embodiment, a method of installing an antenna in a low profile position includes the steps of locating a low profile dipole antenna in a position that is substantially flush with or embedded within a traffic surface, placing a cable having a first end and a second end so that the first end is conductively attached to the antenna, the second end is attached to at least one of a transmitter and a receiver located in a system under the traffic surface, and a portion of the cable located between the ends enters the system through an opening, coating the antenna with a substantially non-conductive covering, and substantially sealing the opening with a sealant.

Optionally, in this method, the position that is substantially flush with the traffic surface is about one-fourth of an inch or less. The non-conductive covering is optionally and preferably is comprised of at least one of rubber, plastic, non-metallic tubing, an adhesive, and a non-metallic substrate. Optionally and preferably, the dipole antenna includes two elongated elements having substantially equal lengths positioned to extend on opposite directions from a point, and the first end of the cable is attached to the elements at the point. Also optionally and preferably, the traffic surface is at least one of a manhole cover, a road, and a sidewalk, and the opening is a standard manhole cover opening, a storm sewer grate, or another opening that is substantially at or near ground level.

There have thus been outlined the more important features of the invention in order that the detailed description thereof that follows may be better understood, and in order that the present contribution to the art may be better appreciated. There are, of course, additional features of the invention that will be described below and which will form at least part of the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting in any way.

As such, those skilled in the art will appreciate that the concept and objectives, upon which this disclosure is based, may be readily used as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
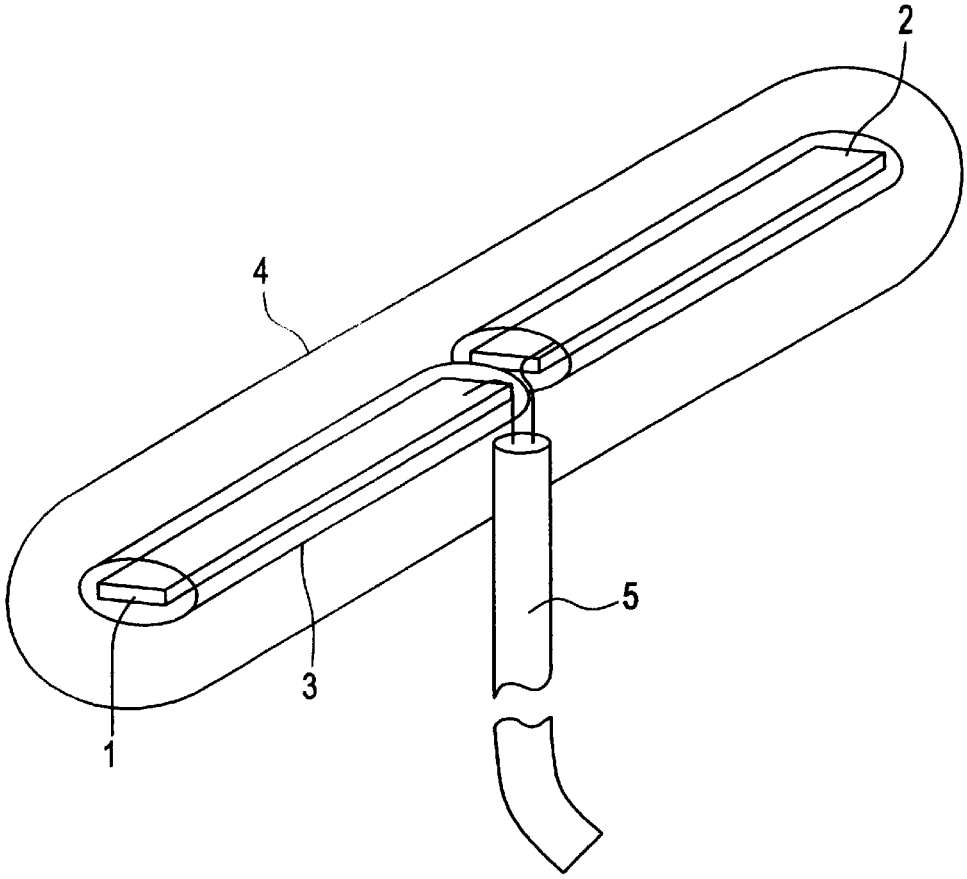
FIG. 1 provides a perspective view illustrating several elements of a preferred embodiment of the present inventive antenna.

The present invention provides an improved antenna having a low profile. The low profile allows the antenna to be used in locations such as manhole covers that are located in roadways or sidewalks, near irrigation systems, and in other locations where traffic may be present, as the low profile helps to protect the antenna as it is contacted by vehicular and/or pedestrian traffic. Preferably, the profile allows the antenna to rest at or below the primary surface of the roadway or sidewalk in an indentation such as a manhole cover groove or recess, storm sewer grate, or other similar location.

In a preferred embodiment, the antenna includes several elements. The elements of this embodiment include two antenna legs that are partially or completely made of a conductive material, such as copper or another metal. One antenna leg serves the function of a ground, the other is generally referred to as the positive side of the antenna. The legs are positioned in parallel with each other and form substantially a straight line, radiating in opposing directions from a central point. The conductive material may be molded or flattened to have a low profile, such as with a copper wire or copper tape. The flexibility allows mounting of the antenna onto a mounting surface. It is not necessary that the mounting surface be smooth, and in fact the mounting surface may be either smooth or irregular. For example, the mounting surface could be a groove, recess, or slot of a manhole cover, a storm sewer grate, or any other location.

The antenna legs are separated by a gap and are connected to a transmitter and/or receiver by a wire such as a standard RF coaxial cable. Preferably, the wire is connected to the antenna legs at or near the gap, i.e., a central point from which each antenna leg radiates in opposing directions generally forming a straight line. In this embodiment, the antenna generally follows the electrical and physical principles that are applicable to a half wave dipole antenna. The coaxial cable is of a diameter small enough to fit through a typical hole or slot in a standard manhole cover. Preferably, the wire is of a diameter not exceeding about one-quarter of an inch. Thus, modification of the manhole cover is preferably not required. Alternately, the present inventive antenna may be used with mounting surfaces such as manhole covers having no holes or slots, in which case modification of the manhole cover or other mounting surface to add a hole or slot to accept the wire will be required. In either case, when a small hole is used, the strength and integrity of the manhole cover or other mounting surface is better preserved. Nonetheless, it should be noted that larger diameter wires, and thus larger holes, may be used in accordance with the present invention.

The antenna wire may be led away from the antenna legs in any direction which suits the necessary mounting arrangement. For example, in the case of mounting the antenna on a flat or slightly contoured surface where only the antenna legs are to be exposed, the antenna wire may be positioned perpendicular to the antenna legs so that it may pass through the surface to which the antenna is mounted, such as through a hole or slot in a manhole cover. Optionally and alternately, the antenna cable may be routed along side the antenna legs until it reaches a suitable position to transition through or off the mounting surface.

Optionally and preferably, the antenna legs are partially, substantially, or entirely housed in a protective covering. The protective material helps to improve durability and protect the conductive elements before and after mounting. The protective covering is substantially, and preferably completely, non-conductive so that the protective covering does not interfere with the operation of the antenna. Preferably, the protective covering is also flexible. Although the protective covering may have either a greater or lesser degree of flexibility than that of the conductive elements, preferably the flexibility of the protective covering will be less than that of the conductive elements. For example, the protective covering may be made of rubber, plastic or other non-conductive material. This protective material may be in the form of a sleeve, encapsulate, sheet, or any other form. In addition, the protective covering may be attached to, or even replaced by a substrate such as a non-metallic semiconductor or circuit board substrate. The protective covering helps to reduce the risk of damage to the conductive elements during handling, transport, and installation of the antenna.

The conductive elements and the protective covering may be further encased in an external coating. This external coating may be included with the antenna, or it may be added when the antenna is installed in its final service location. The external coating substantially or completely seals the assembly against the intrusion of water or other fluids. It also serves to seal and protect the antenna cable to prevent water from entering the cable.

The final external coating, also referred to herein as an encapsulation material, is preferably a moldable material that exhibits high strength once cured, and it preferably has a tensile strength and is able to endure loads as high as several thousand PSI or higher. Preferably, it is moldable to the contour available on the mounting surface. The encapsulation material preferably also has the properties of being impermeable to water, solvents, salts and other common such materials. Preferably, the external coating or encapsulation material is durable, machinable, and has fast curing properties to allow relatively quick installation, and use shortly after installation. For example, in a preferred embodiment, the external coating may be comprised of an epoxy, or of rubber or plastic with an adhesive, that serves to fixedly attach the antenna to a mounting surface.

The antenna wire, in the area where it is connected to the antenna legs, is also preferably covered or encapsulated by the protective covering and/or the external coating. In addition, the hole or slot through which the antenna wire passes through is also preferably filled with the protective covering and/or the external coating, thus substantially or completely sealing the antenna wire and the connections to the antenna legs against water intrusion. The encapsulation in this area also acts to secure the antenna wire and make it resistant to external loads that may be applied to the antenna wire in its normal usage.

It should be noted that, while the above-described embodiment is a preferred embodiment, additional variations are possible. For example, a single antenna leg may be used, or more than two legs may be used, and the leg or legs may be positioned in a loop, a curve, or some orientation other than a straight line so long as the resulting antenna has a low profile. The antenna legs, being made of conductive material, can take on a variety of construction techniques to address cost, mounting techniques, and desired signal pattern. In addition, in an alternate embodiment, the protective covering is not included and the antenna legs are directly mounted to a mounting surface with only the external coating serving as both a protectant and an adhesive. Also optionally, the protective covering and the external coating may be integral with each other, or they may comprise the same item or material, such as for example a plastic or rubber having adhesive qualities. As an additional option, the protective covering and/or the external coating may be made of a material that partially or entirely degrades or disintegrates, thus leaving only one of the two materials to protect the antenna.

The preferred embodiment described above is illustrated in FIG. 1. Referring to FIG. 1, a dipole antenna includes conductive elements 1 and 2 that serve as the antenna legs. Preferably, the conductive elements 1 and 2 are flexible to allow the elements to be positioned in various locations. The conductive elements 1 and 2 are made of a conductive material such as copper wire, copper tape, or any other conductive material that may be molded or flattened and has a low profile.

Figure 2:
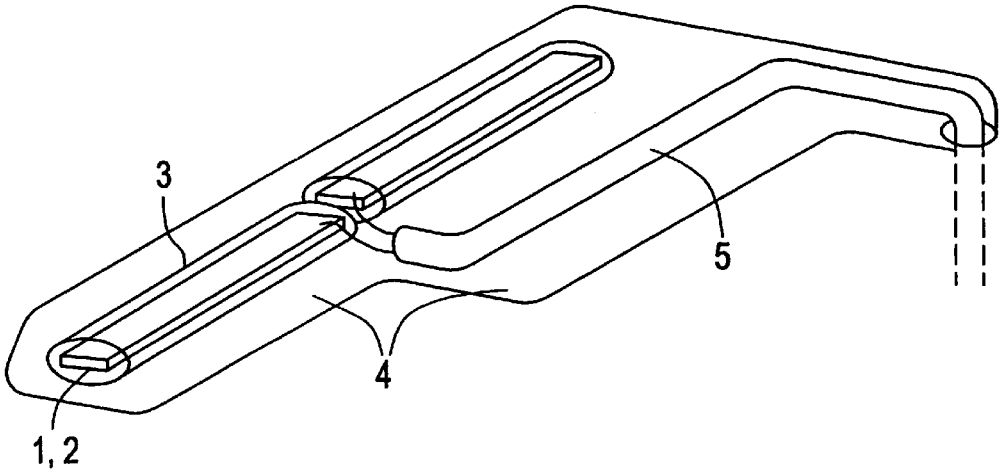
FIG. 2 provides a perspective view illustrating several elements of an alternate embodiment of the present inventive antenna.

An antenna cable 5 is attached to the antenna legs, preferably at or near the gap that separates the legs. The cable preferably includes at least two conductors so that one conductor can be attached to the antenna leg that serves as ground and the other conductor can be attached to the antenna leg that is designated as positive. As FIG. 1 illustrates, the cable may be positioned to extend from the legs in a direction that is perpendicular to the legs. Alternately, as illustrated in FIG. 2, the cable may run alongside the legs, or the cable may extend from the legs in any other direction.

Returning to FIG. 1, the elements are preferably encased in a flexible, non-conductive protective covering 3. As noted above, the protective covering may be made of rubber, plastic, or any other non-conductive material. Although FIG. 1 illustrates an embodiment where the elements are completely encased within the protective covering, optionally the protective covering may cover only a portion of the elements, such as the top of the elements.

Optionally and preferably, the conductive elements and/or the protective covering may be further encased in or covered by an external coating 4. This external coating may be included with the antenna, or it may be added when the antenna is installed in its final service location. In a preferred embodiment, the external coating 4 is comprised of an epoxy, or of rubber or plastic with an adhesive, that serves to fixedly attach the antenna to a mounting surface. As illustrated in FIG. 2, the external coating 4 is preferably applied to all or part of the antenna wire 5 that is located above the mounting surface.

Figure 3:
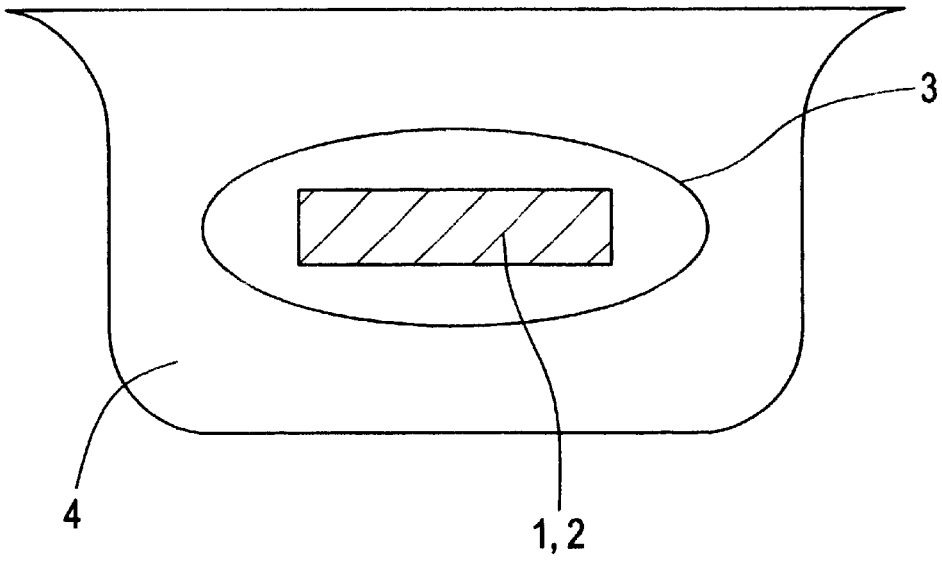
FIG. 3 provides an end view illustrating several elements of the preferred embodiment of FIG. 1

FIG. 3 provides a side view of the preferred embodiment of FIG. 1 and illustrates that the conductive elements 1 and 2 are covered by the protective covering 3, which is in turn covered by the external coating 4. In an alternate embodiment, protective covering 3 is not included and the antenna legs are directly mounted to a mounting surface with only the external coating 4 serving as both a protectant and an adhesive. Also optionally, protective covering 3 and external coating 4 are integral or the same item or material.

The final assembly consists of placing the antenna wire through a suitably sized hole in the mounting surface or running the wire alongside or nearby the antenna legs to a point where the antenna wire can be routed to its final connection to the transmitter and/or receiver. For example, the transmitter/receiver may be mounted inside of a manhole, and the antenna may be installed on the manhole cover by threading the wire through a hole in the manhole cover, attaching the wire to the antenna legs, preparing the antenna legs to adhere to a mounting surface such as by adding an adhesive, and placing the antenna legs on the manhole cover or within one or more grooves in the manhole cover so that the adhesive attaches the antenna legs to the mounting surface. The antenna wire is also attached to the transmitter/receiver within the manhole. Preferably, a disconnect is included between the antenna and the transmitter/receiver to allow removal of the manhole cover without damaging the antenna, the wire, or the transmitter/receiver.

Optionally and alternatively, the antenna may be mounted on a surface other than the manhole surface, such as on a roadway, or even partially or completely embedded within and/or flush with the surface such as in concrete, asphalt, other pavement, or even a floor or wall that is subject to traffic or force. In such an embodiment, the wire may be run to the manhole cover to be passed through a hole, or it may enter the manhole through a hole in the manhole side or a location other than the cover. It may also be passed through other locations, such as storm sewer grates, tire or track grooves, irrigation system recesses, or other locations In such configurations, the wire may run along a surface, or it may be positioned within a groove, a trench, a conduit, or another enclosed or partially enclosed location. FIG. 3 illustrates an example of an antenna that is capable of such a configuration.

As an additional option, the wire may be passed through an existing hole in the manhole or manhole cover, or a hole may be drilled for insertion of the wire. In such a configuration, the hole, after the wire is passed through it, is preferably filled with an epoxy and/or a sealant.

The construction of the antenna as a dipole provides two "legs," or antenna elements, having substantially equal lengths and extending in opposite directions from a central point. Prior art dipole antennas generally must be mounted a distance, typically one-half-wavelength or more above the ground. This antenna, however, is specially tuned to optimize performance in a low profile configuration. Specifically, the leg lengths are specially tuned to compensate for the antenna's close proximity to other construction features. Preferably, in an embodiment of this invention where the frequency of the transmitter is consistent with that of a wireless telephone, the overall combined length of the legs is between about six-and-one-half and about seven-and-one-half inches. Surprisingly and advantageously, we have found that such a length yields satisfactory results when the antenna is on or flush with a surface. This also satisfies the antenna impedance requirements for the connected transmitter and/or receiver.

The low profile of the antenna allows unique mounting opportunities. When attached to a flat surface, it provides for a low profile above the flat surface, helping to make the antenna resistant to damage from objects moving across the surface. When mounted on a textured surface it may be oriented to utilize any surface pattern which will allow the antenna to conform to surface recesses, thus making it low in height relative to the surface to which it is attached. Preferably, the height of the antenna is no greater than about one-quarter inch, although antennas having greater height may be used so long as the overall profile above ground is low or non-existent.

The low profile also allows for the use of an antenna assembly having more than one dipole element. In this optional configuration, each dipole element would be mounted side-by-side, substantially in parallel with a space between each dipole element. The dipole elements are each comprised of two "legs" but may be of different lengths, widths, and/or thicknesses to provide multiple transmission and/or reception frequencies. For example, a configuration may include a dipole element used for transmission on one frequency and a second dipole element used for reception on another frequency. Preferably, the multiple dipole elements are encased within a common protective covering and/or external coating. Also preferably, the external appearance of such a configuration is not substantially different from the appearance of an embodiment using only a single dipole.

This antenna offers particularly low cost of construction and allows varied installation techniques which can be tailored to the surface conditions presented at time of installation. The antenna design is also such that, when installed in locations such as manhole covers, the antenna is nearly invisible to the pedestrian, thus making it less susceptible to vandalism. Penetration requirements when mounted directly on the manhole are minimal compared to mechanically attached antennas.

The low profile of the present inventive antenna thus reduces or eliminates the susceptibility for damage of the antenna resulting from roadway traffic. This invention also minimizes or eliminates any alteration of the manhole cover or other mounting surface itself for the purpose of installation. For example, many manhole covers are provided with grooves and/or small holes or other recesses, which this invention can use for mounting of the antenna. Prior art in this area requires substantial alteration of the manhole cover to allow mounting of the antenna. Where manhole covers are solid in construction, this invention requires only a small hole or slot to allow the antenna wire to pass from below the manhole cover to above the manhole cover. Prior art antennas of this nature require large holes to serve to secure the antenna to the manhole cover mechanically using a device that passes through the manhole cover.

Another improvement offered by this invention is the ease of installation. Through the use of fast curing adhesives or encapsulate materials, the antenna can be placed on the manhole or adjacent roadway and secured within a short period of time with minimal skill or tools required to complete the process. Optionally and preferably, no bolting or welding is required. This design produces an antenna that is relatively inexpensive when compared to conventional antenna designs that rely more fully on mechanical mounting means and mechanical structure to make the antenna durable to roadway conditions.

This invention also permits mounting of the antenna on a manhole cover, or directly on or in the roadway with minimal excavation, to route the antenna wire or achieve a suitable cavity into which the antenna is secured using suitable adhesives or filler materials. Because the antenna is not totally rigid prior to installation, it offers flexibility during the installation process, even when installation conditions are less than ideal.

The antenna offers several opportunities for delivery of data signals to or from the transmitter and/or receiver to which it is connected. For example, the antenna may be connected to a flow meter located within a sewer network, and the antenna could electrically transmit the data collected by the flow meter to a receiver such as a central data collection point, a mobile receiver such as a receiver mounted in a vehicle, or even a hand-held receiver.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, all of which may fall within the scope of the invention.

What is claimed is:

1. A low profile antenna comprising:

a first elongated element made from an electrically conductive material;

a second elongated element made from the electrically conductive material; and a cable that is conductively attached to the first and second elongated elements;

wherein the first and second elongated elements each have a height that is of a low profile and lengths that are substantially equal; and wherein each elongated element is covered at least partially with a substantially non-conductive covering.

2. The antenna of claim 1 wherein the first elongated element and the second elongated element are positioned to extend in opposite directions, form substantially a straight line, and are separated by a gap to provide a dipole antenna.

3. The antenna of claim 2 wherein the substantially straight line formed by the first and second elements has a length that corresponds to an operating frequency band of the antenna.

4. The antenna of claim 3 wherein the length provides an electrically tuned antenna that is capable of transmission in close proximity to a surface.

5. The antenna of claim 1 wherein the first elongated element and the second elongated element are sized and positioned to fit within one or more grooves or recesses of a standard manhole cover.

6. The antenna of claim 1 wherein the electrically conductive material comprises copper.

7. The antenna of claim 1 wherein the height that is of a low profile is about one-fourth of an inch or less.

8. The antenna of claim 1 wherein the cable has a diameter that is at least as small as the diameter of a standard manhole cover opening.

9. The antenna of claim 1 wherein the substantially non-conductive covering is comprised of at least one of rubber, plastic, non-metallic tubing, an adhesive, and a non-metallic substrate.

10. The antenna of claim 1 further comprising an adhesive material that is affixed to at least a portion of the substantially non-conductive covering.

11. The antenna of claim 1 wherein the elongated elements are positioned within at least one groove of a standard manhole cover.

12. The antenna of claim 1 wherein the elongated elements are embedded within or flush with a traffic surface.

13. The antenna of claim 1 wherein the cable is also connected to at least one of a transmitter and a receiver.

14. The antenna of claim 1 wherein said first elongated element and said second elongated element are sized and positioned to fit within one or more grooves or recesses of a standard manhole cover and wherein said elongated elements are at least partially embedded within a sealant that at least partially fills a volume of said grooves.

15. The antenna of claim 14 wherein said sealant is an epoxy.

16. The antenna of claim 1 wherein the combined length of all elongated elements is substantially in the range between about six-and-one-half to seven-and-one-half inches.

17. The antenna of claim 1 wherein said elongated elements are disposed within at least one groove of a traffic surface and said cable passes through a hole in said surface that is continuous with said at least one groove and extends to a cavity below said surface.

18. The antenna of claim 17 wherein said elongated elements and said cable are at least partially embedded in a sealant that fills at least a portion of said at least one groove and said hole in the surface.

19. The antenna of claim 17 wherein said sealant is an epoxy.

20. The antenna of claim 17 wherein said traffic surface is selected from the group consisting of roadway, sidewalk, decking, floor, stairway, storm sewer grating, and manhole cover.

21. A method of installing an antenna in a low profile position, comprising;

locating a low profile dipole antenna in a position that is substantially flush with or embedded within a traffic surface;

placing a cable having a first end and a second end so that the first end is conductively attached to the antenna, the second end is attached to at least one of a transmitter and a receiver located in a system under the traffic surface, and a portion of the cable located between the ends enters the system through an opening;

coating the antenna with a substantially non-conductive covering; and substantially sealing the opening with a sealant.

22. The method of claim 21 wherein the position that is substantially flush with the traffic surface is about one-fourth of an inch or less.

23. The method of claim 21 wherein the non-conductive covering is comprised of at least one of rubber, plastic, non-metallic tubing, an adhesive, and a non-metallic substrate.

24. The method of claim 21 wherein the dipole antenna comprises two elongated elements having substantially equal lengths positioned to extend on opposite directions from a point, and the first end of the cable is attached to the elements at the point.

25. The method of claim 21 wherein the traffic surface is at least one of a storm sewer grate, a manhole cover, a road, and a sidewalk.

26. The method of claim 21 wherein the opening is a standard manhole cover opening.

27. The method of claim 21 wherein the position that is substantially flush with the traffic surface is one or more grooves in said surface, wherein said elongated elements are disposed within said one or more grooves, and said sealant at least partially fills and seals said one or more grooves.

28. The method of claim 27 wherein said sealant is an epoxy.

29. The method of claim 21 further comprising: cutting one or more grooves into said surface; drilling a hole that is continuous with at least one of said one or more grooves and that extends to a cavity below said surface; locating said elongated elements within said grooves, disposing said cable through said hole into said cavity; and filling at least a portion of the volume of said hole and said one or more grooves with the sealant such that at least a portion of the elongated elements is embedded within said sealant.

30. The method of claim 29 wherein said surface is a portion of a roadway or sidewalk situated within about two feet of a manhole cover or storm sewer grating and said cavity is a storm sewer or sewer pipe below said manhole cover or storm sewer grating.

31. The method of claim 29 wherein said sealant is an epoxy.

32. An antenna apparatus comprising:

a traffic surface;

a first and a second elongated conductive element fixedly secured to said traffic surface, said conductive elements having a low height profile relative to said surface and being at least partially covered with a substantially non-conductive covering; and a cable conductively attached to said elongated elements.

33. The antenna apparatus of claim 32 wherein said traffic surface is at least one of a storm sewer grating, a manhole cover, a road, or a sidewalk.

34. The antenna apparatus of claim 32 wherein said traffic surface is a manhole cover having an upper and a lower surface and one or more grooves or recesses in said upper surface; the first and second elongated elements are sized to fit and positioned within said one or more grooves or recesses of the manhole cover; wherein said elongated elements are at least partially embedded within a sealant that at least partially fills a volume of said grooves; said cable passes through a hole of said manhole cover extending from said upper to said lower surface; and wherein said hole is at least partially filled with a sealant.

35. The antenna apparatus of claim 34 wherein said sealant is an epoxy.

* * * * *